US009087487B2

(12) United States Patent
Abe et al.

(10) Patent No.: US 9,087,487 B2
(45) Date of Patent: Jul. 21, 2015

(54) DRIVING DEVICE OF IMAGE DISPLAY MEDIUM, IMAGE DISPLAY APPARATUS, AND NON-TRANSITORY COMPUTER-READABLE MEDIUM STORING DRIVING PROGRAM WITH AN EXTERNAL ENVIRONMENT ACQUIRING UNIT

(71) Applicant: FUJI XEROX CO., LTD., Tokyo (JP)

(72) Inventors: Masaaki Abe, Kanagawa (JP); Yasufumi Suwabe, Kanagawa (JP); Yoshinori Machida, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 135 days.

(21) Appl. No.: 13/927,724

(22) Filed: Jun. 26, 2013

(65) Prior Publication Data

US 2014/0247258 A1 Sep. 4, 2014

(30) Foreign Application Priority Data

Mar. 1, 2013 (JP) ..... 2013-040795

(51) Int. Cl.
*G09G 3/34* (2006.01)

(52) U.S. Cl.
CPC ..... *G09G 3/344* (2013.01); *G09G 2300/0473* (2013.01); *G09G 2320/0209* (2013.01); *G09G 2320/041* (2013.01)

(58) Field of Classification Search
CPC ..... G09G 3/344; G09G 2320/041; G09G 2320/0209
USPC ..... 345/107, 211
See application file for complete search history.

(56) References Cited

U.S. PATENT DOCUMENTS

2007/0018945 A1 1/2007 Machida et al.
2008/0117165 A1 * 5/2008 Machida et al. ..... 345/107

FOREIGN PATENT DOCUMENTS

JP A-2007-033707 2/2007

* cited by examiner

*Primary Examiner* — Jonathan Blancha
(74) *Attorney, Agent, or Firm* — Oliff PLC

(57) ABSTRACT

A driving device of an image display medium includes an electric field applying unit that applies an electric field between a pair of substrates of an image display medium including first particles of which a first start voltage and a first end voltage vary depending on a variation in external environment and second particles of which a second start voltage and a second end voltage vary depending on the variation in external environment, an external environment acquiring unit, an information storage unit that stores information of an initial driving electric field for applying an adhesive force, the absolute value of which satisfies the first start voltage<the first end voltage<the second start voltage<the second end voltage, to the first and second particles depending on the external environment information and information of a writing electric field to be applied to the particles, and a controller that controls the electric field applying unit.

4 Claims, 10 Drawing Sheets

FIG. 4B

○ : NO COLOR MIXTURE
× : COLOR MIXTURE

| C DENSITY | | M DENSITY | | | | |
|---|---|---|---|---|---|---|
| | | DM0 | DM1 | DM2 | DM3 |
| DC0 | 40 °C | ○ | ○ | ○ | ○ |
| | 60 °C | ○ | ○ | ○ | × |
| | 80 °C | ○ | ○ | × | × |
| DC1 | 40 °C | ○ | ○ | ○ | ○ |
| | 60 °C | ○ | ○ | ○ | ○ |
| | 80 °C | ○ | ○ | ○ | × |
| DC2 | 40 °C | ○ | ○ | ○ | ○ |
| | 60 °C | ○ | ○ | ○ | ○ |
| | 80 °C | × | ○ | ○ | ○ |
| DC3 | 40 °C | ○ | ○ | ○ | ○ |
| | 60 °C | × | ○ | ○ | ○ |
| | 80 °C | × | × | ○ | ○ |

DRIVING DEVICE OF IMAGE DISPLAY MEDIUM, IMAGE DISPLAY APPARATUS, AND NON-TRANSITORY COMPUTER-READABLE MEDIUM STORING DRIVING PROGRAM WITH AN EXTERNAL ENVIRONMENT ACQUIRING UNIT

CROSS-REFERENCE TO RELATED APPLICATIONS

This application is based on and claims priority under 35 USC 119 from Japanese Patent Application No. 2013-040795 filed Mar. 1, 2013.

BACKGROUND (i) Technical Field

The present invention relates to a driving device of an image display medium, an image display apparatus, and a non-transitory computer-readable medium storing a driving program.

(ii) Related Art

Recently, an image display medium using colored particles has been known as a rewritable image display medium having a memory property. Such an image display medium includes, for example, a pair of substrates and plural types of particle groups enclosed between the substrates so as to migrate between the substrates with an applied electric field and having different colors and charging characteristics.

In such an image display medium, a voltage corresponding to an image is applied to across a pair of substrate to cause particles to migrate and the image is displayed using the contrast of particles having different colors. Even after the image is displayed and the application of the voltage is stopped, the particles continue to be attached to the substrates with a van der Waals force or an image force and thus the display of the image is maintained.

SUMMARY

According to an aspect of the present invention, there is provided a driving device of an image display medium including: an electric field applying unit that applies an electric field between a pair of substrates, at least one of which has a light-transmitting property, of an image display medium including first particles of which a first start voltage for starting migration and a first end voltage for ending the migration vary depending on a variation in external environment and second particles of which a second start voltage for starting migration and a second end voltage for ending the migration vary depending on the variation in external environment and displaying an image on the basis of image information, the first particles and the second particles being enclosed between the pair of substrates; an external environment acquiring unit that acquires external environment information; an information storage unit that stores information of an initial driving electric field for applying an adhesive force, the absolute value of which satisfies the first start voltage<the first end voltage<the second start voltage<the second end voltage, to the first particles and the second particles depending on the external environment information and information of a writing electric field to be applied to the respective particles on the basis of the external environment information and a color to be displayed; and a controller that controls the electric field applying unit so as to apply an electric field between the pair of substrates on the basis of the color to be displayed and the information of the writing electric field stored in the information storage unit after applying the initial driving electric field between the pair of substrates on the basis of the external environment information and the information of the initial driving electric field stored in the information storage unit.

BRIEF DESCRIPTION OF THE DRAWINGS

Exemplary embodiments of the present invention will be described in detail based on the following figures, wherein:

FIG. 33 is a diagram illustrating a variation in threshold characteristics of particles when the environmental temperature is 20° C. and 60° C.;

FIG. 4B is a diagram illustrating an example of a table showing occurrence of color mixture for each environmental temperature and each density;

DETAILED DESCRIPTION

Figure 1A:
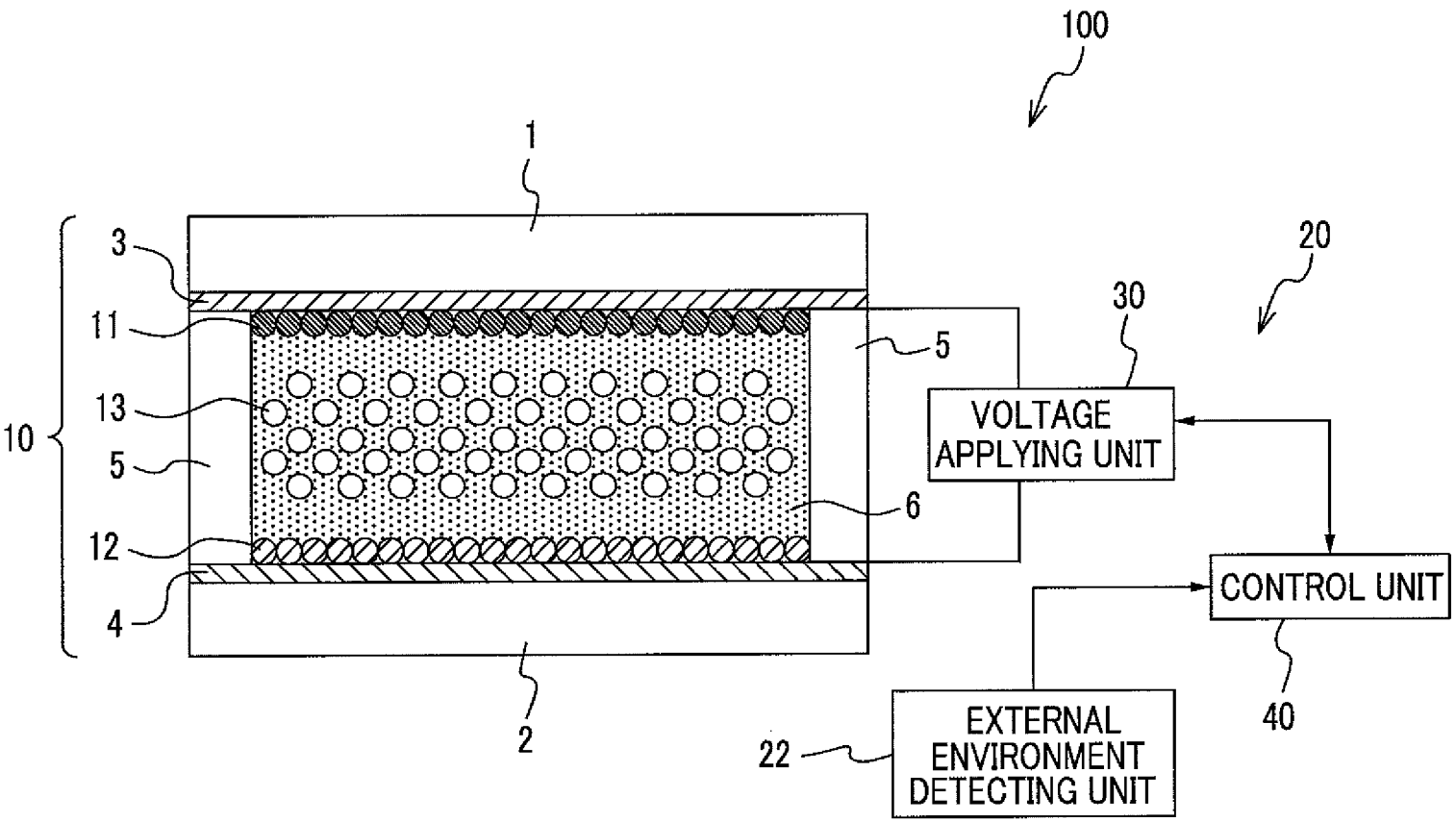
FIGS. 1A and 1B are diagrams schematically illustrating an image display apparatus according to an exemplary embodiment of the present invention.

Hereinafter, exemplary embodiments of the present invention will be described with reference to the accompanying drawings. Elements having like operational functions will be referenced by like reference numerals in the overall drawings and description thereof may not be repeated. For the purpose of simple explanation, the exemplary embodiments will be described with reference to the drawings appropriately showing a single cell.

It is assumed that cyan colored particles and magenta colored particles are used as colored particles in the exemplary embodiments. The cyan colored particles are referred to as cyan particles C, the magenta colored particles are referred to as magenta particles M, and the particles and the particle groups are referenced by the same reference signs (numerals).

FIG. 1A schematically illustrates an image display apparatus according to an exemplary embodiment of the present invention. The image display apparatus 100 includes an image display medium 10 and a driving device 20 driving the image display medium 10. The driving device 20 includes a voltage applying unit 30 applying a voltage between a display electrode 3 and a rear electrode 4 of the image display medium 10 and a controller 40 controlling the voltage applying unit 30 on the basis of image information of an image to be displayed on the image display medium 10.

The image display medium 10 includes a pair of substrates in which a display substrate 1 having a light-transmitting property and serving as an image display plane and a rear substrate 2 serving as a non-display plane are disposed to oppose each other with a gap therebetween.

Spacer members 5 are provided which maintain the substrates 1 and 2 at a fixed gap and which partition the space between the substrates into plural cells.

The cell represents a region surrounded with the rear substrate 2 having the rear electrode 4 disposed thereon, the display substrate 1 having the display electrode 3 disposed thereon, and the spacer members 5. A dispersion medium 6 including, for example, an insulating liquid and a first particle group 11, a second particle group 12, and a white particle group 13 dispersed in the dispersion medium 6 are enclosed in the cell.

The first particle group 11 and the second particle group 12 have different threshold characteristics for migration depending on the color and the electric field and have characteristics in which the first particle group 11 and the second particle group 12 independently migrate by applying a voltage equal to or larger than a predetermined threshold voltage between the pair of electrodes 3 and 4. On the other hand, the white particle group 13 is a particle group which has a smaller amount of electric charge than those of the first particle group 11 and the second particle group 12 and which does not migrate to any electrode even when a voltage for causing any one of the first particle group 11 and the second particle group 12 to migrate to any one electrode is applied between the electrodes.

White other than the colors of the electrophoretic particles may be displayed by mixing colorants into the dispersion medium.

The driving device 20 (the voltage applying unit 30 and the controller 40) applies a voltage based on a color to be displayed between the display electrode 3 and the rear electrode 4 of the image display medium 10 so as to cause the particle groups 11 and 12 to migrate and to attract the particle groups to any one of the display substrate 1 and the rear substrate 2 depending on the charged polarities thereof.

The voltage applying unit 30 is electrically connected to the display electrode 3 and the rear electrode 4. The voltage applying unit 30 is connected to the controller 40 so as to transmit and receive signals thereto and therefrom.

Figure 1B:
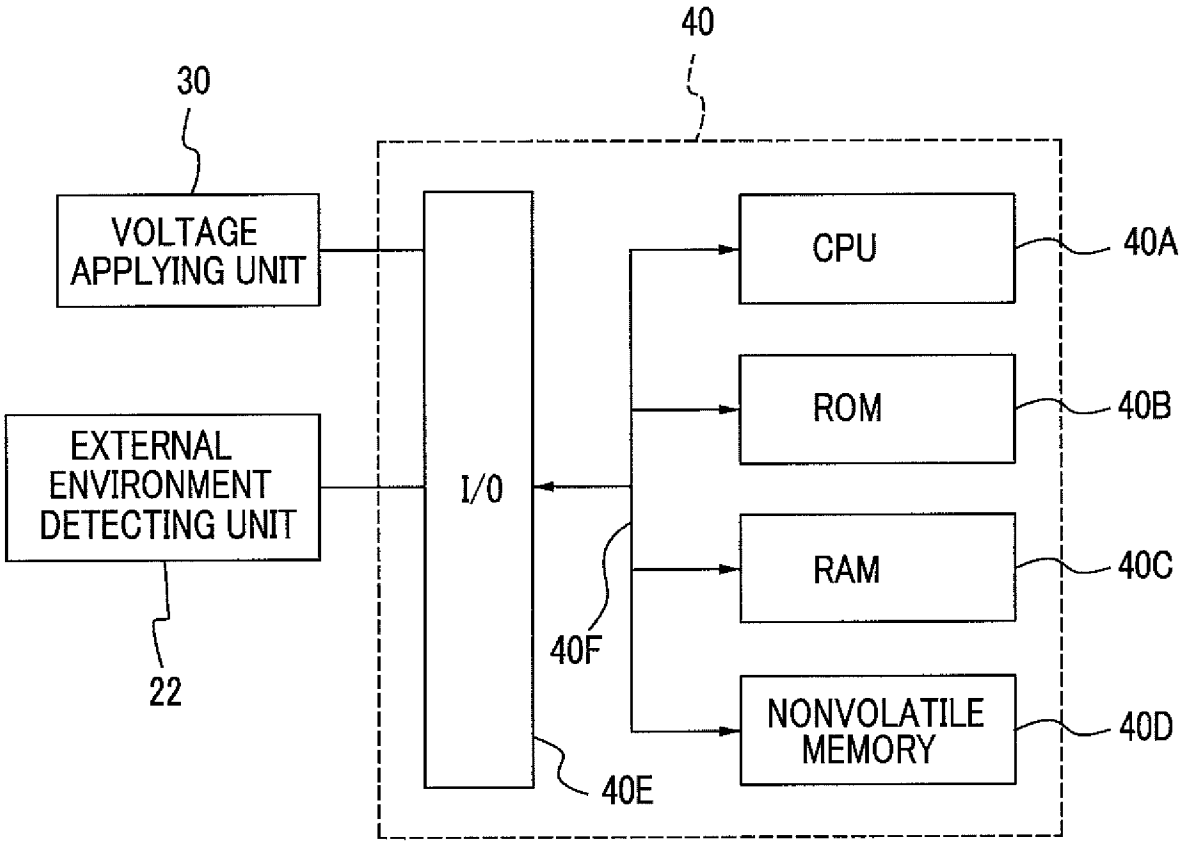

The controller 40 is constructed, for example, as a computer 40 as shown in FIG. 1B. For example, the computer 40 has a configuration in which a central processing unit (CPU) 40A, a read only memory (ROM) 40B, a random access memory (RAM) 40C, a nonvolatile memory 40D, and an input and output interface (I/O) 40E are connected to each other via a bus 40F and the voltage applying unit 30 is connected to the I/O 40E. In this case, a program causing the computer 40 to perform processes for instructing the voltage applying unit 30 to apply a voltage necessary for display of colors is written to, for example, the nonvolatile memory 40D and is read and executed by the CPU 40A. The program may be provided through the use of a recording medium such as a CD-ROM.

The voltage applying unit 30 is a voltage application device used to apply a voltage to the display electrode 3 and the rear electrode 4 and applies a voltage corresponding to the control of the controller 40 to the display electrode 3 and the rear electrode 4.

In this exemplary embodiment, for example, it is assumed that the rear electrode 4 is grounded and a voltage is applied to the display electrode 3.

An external environment acquiring unit 22 that acquires external environment information of the image display medium 10 is connected to the controller 40. The external environment acquiring unit 22 acquires external environment information as a factor for changing threshold characteristics of the particles enclosed between the pair of substrates of the image display medium 10. In this exemplary embodiment, for example, the external environment acquiring unit detects the environmental temperature of the image display medium 10 and outputs the detection result to the controller 40. That is, the external environment acquiring unit 22 is connected to the I/O 40E and the detection result is output to the controller 40. Light may be acquired as the external environment information and may be converted into a temperature.

Figure 2:
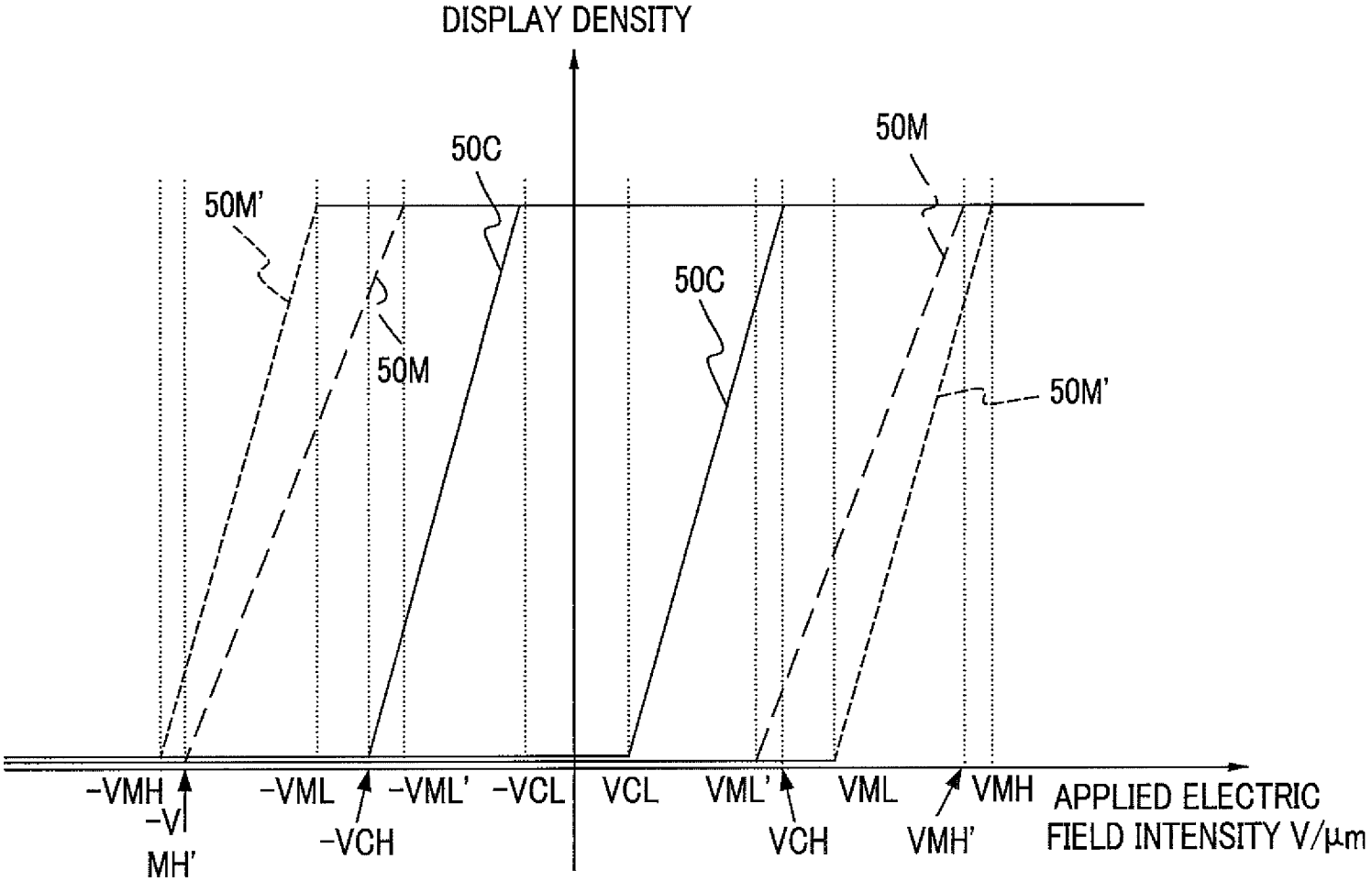
FIG. 2 is a diagram illustrating threshold characteristics of electrophoretic particles.

FIG. 2 illustrates a relationship (threshold characteristics) between an electric field intensity (V/μm) to be applied between the substrates and a display density of each particle group when the rear electrode 4 is grounded (0 V) and a voltage is applied to the display electrode 3. In FIG. 2, the threshold characteristic of the cyan particles C is referenced by 50C and the threshold characteristic of the magenta particles M is referenced by 50M. In this exemplary embodiment, it is assumed that the magenta particles M are charged to the negative polarity and the cyan particles C are charged to the negative polarity.

As shown in FIG. 2, the electric field intensity (threshold electric field intensity) at which the magenta particles M charged to the negative polarity on the side of the rear substrate 2 start migration to the display substrate 1 is +VML and the electric field intensity (threshold electric field intensity) at which all the magenta particles M end the migration to the display substrate 1 is +VMH. The electric field intensity (threshold electric field intensity) at which the magenta particles M on the side of the display substrate 1 start migration to the rear substrate 2 is −VML and the electric field intensity (threshold electric field intensity) at which all the magenta particles M end the migration to the rear substrate 2 is −VMH.

Therefore, the magenta particles M on the side of the rear substrate 2 start migration to the display substrate 1 by applying an electric field intensity of +VML or more between the substrates, and all the magenta particles M migrate to the display substrate 1 by applying an electric field intensity of +VMH or more between the substrates. The magenta particles M on the side of the display substrate 1 start migration to the rear substrate 2 by applying an electric field intensity of −VML or less between the substrates, and all the magenta particles M migrate to the rear substrate 2 by applying an electric field intensity of −VMH or less between the substrates.

The electric field intensity (threshold electric field intensity) at which the cyan particles C on the side of the rear substrate 2 start migration to the display substrate 1 is VCL, and the electric field intensity (threshold electric field intensity) at which all the cyan particles C end the migration to the display substrate 1 is VCH. The electric field intensity (threshold electric field intensity) at which the cyan particles C on the side of the display substrate 1 start migration to the rear substrate 2 is −VCL, and the electric field intensity (threshold electric field intensity) at which all the cyan particles C end the migration to the rear substrate 2 is −VCH.

Therefore, the cyan particles C on the side of the rear substrate 2 start migration to the display substrate 1 by applying an electric field intensity of +VCL or more, and all the cyan particles C migrate to the display substrate 1 by applying an electric field intensity of +VCH or more between the substrates. The cyan particles C on the side of the display substrate 1 start migration to the rear substrate 2 by applying an electric field intensity of −VCL or less, and all the cyan particles C migrate to the rear substrate 2 by applying an electric field intensity of −VCH or less between the substrates.

In this exemplary embodiment, it is assumed that the threshold characteristics of the magenta particles M and the cyan particles C are set in advance so as not to overlap with each other at a predetermined environmental temperature (for example, 20° C.) and the particles are able to be driven independently.

In the image display medium 10 having this configuration, since the display characteristics of the particles vary depending on a variation in external environment of the image display medium 10, the display characteristics needs to be corrected. As in this exemplary embodiment, when plural types of particles are used, the variation characteristic differs depending on the types of the particles and thus the same correction should not be performed on all the particles.

Figure 3A:
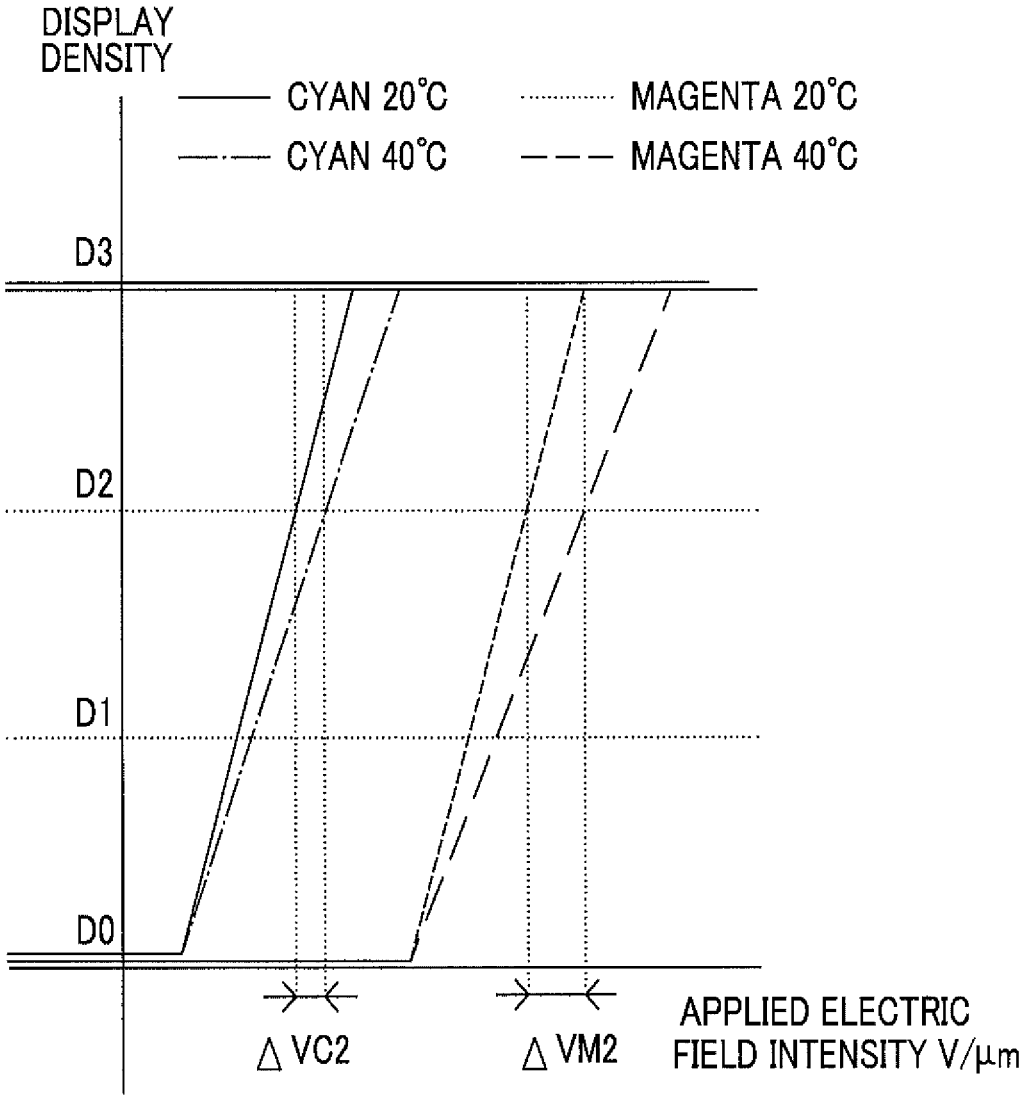
FIG. 3A is a diagram illustrating a variation in threshold characteristics of particles when the environmental temperature is 20° C. and 40° C.

In the image display medium 10, for example, as shown in FIG. 3A, when the environmental temperature is changed from 20° C. to 40° C., an applied electric field intensity for displaying the cyan particles C with a density of D2 is changed by ΔVC2 and an applied electric field intensity for displaying the magenta particles M with a density of D2 is changed by ΔVM2. Accordingly, as can be seen from the variation shown in FIG. 3A, a color to be displayed may not be displayed with the same amount of correction.

Figure 3B:
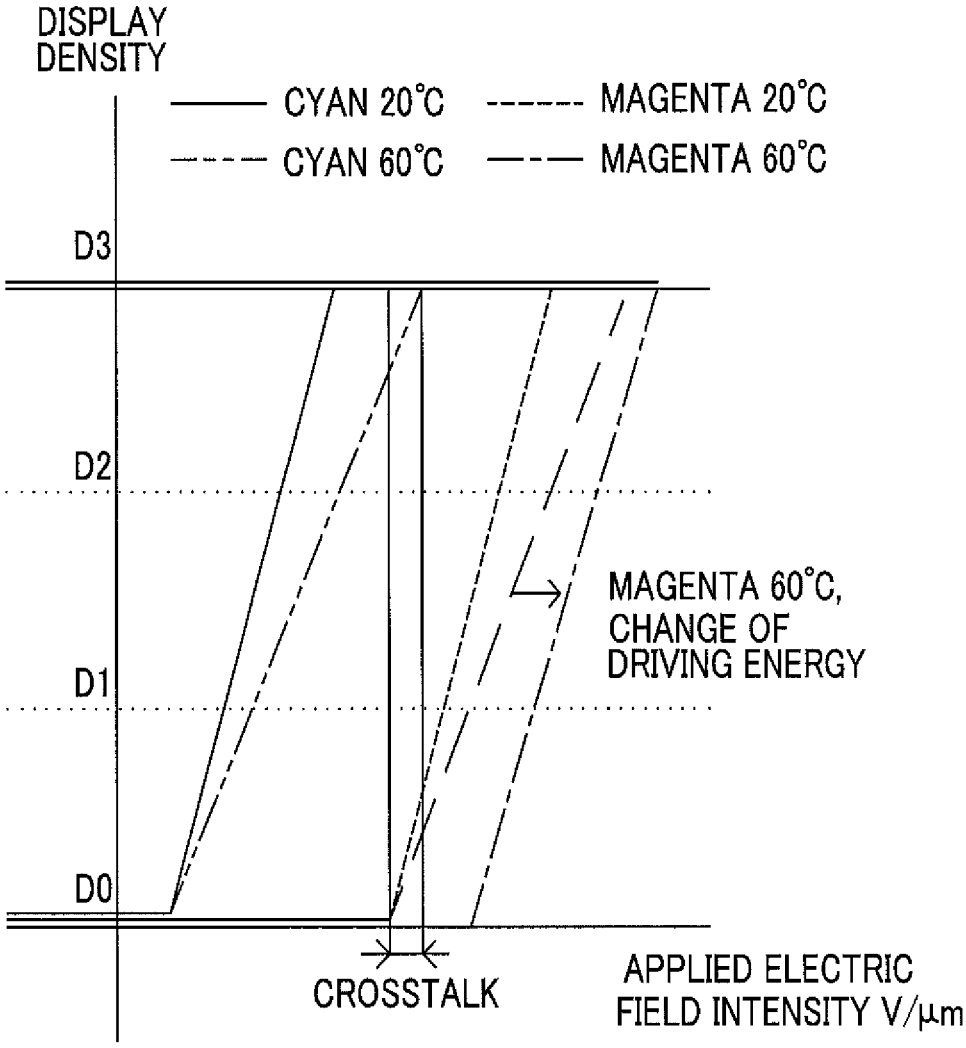

When the environmental temperature is changed to 60° C., color mixture (hereinafter, also referred to as crosstalk) occurs as shown in FIG. 3B. That is, when a region in which the cyan threshold characteristic and the magenta threshold characteristic overlap with each other is present and, for example, a voltage for displaying cyan with the maximum density is applied in this state, magenta is also displayed and a color in which cyan and magenta are mixed is displayed on the display screen. In this way, the state in which the threshold characteristics overlap in a certain electric field region is referred to as crosstalk, and the state in which particles other than particles to be displayed are displayed is referred to as color mixture.

Therefore, in this exemplary embodiment, the external environment information detected by the external environment acquiring unit 22 is acquired and corrections different depending on the particles are performed on the basis of the acquired external environment information. At this time, when the acquired external environment information represents an external environment causing the crosstalk, the controller 40 performs a control of changing the threshold characteristics. Details of the method of changing the threshold characteristics will be described later.

Figure 4A:
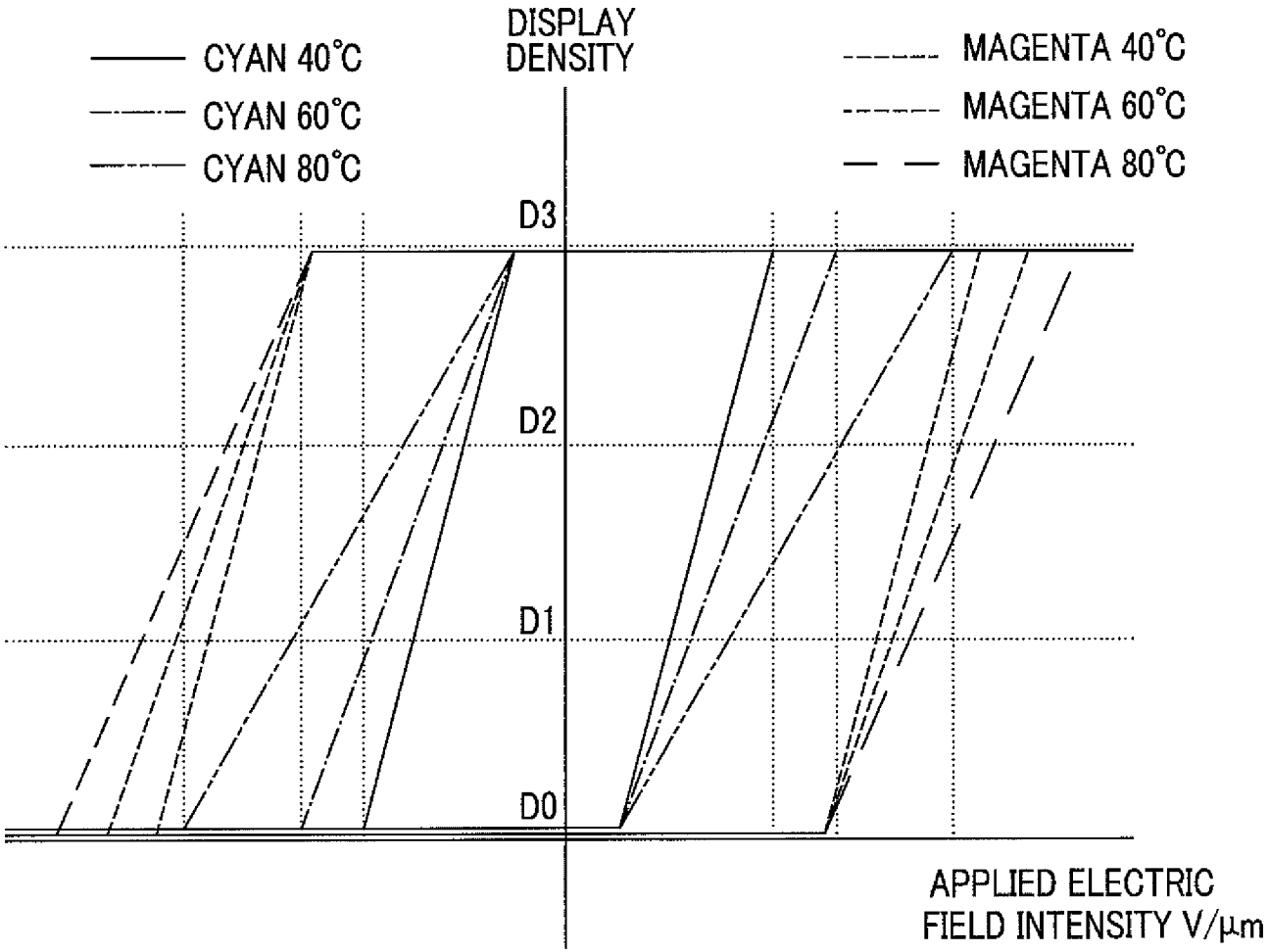
FIG. 4A is a diagram illustrating an example of threshold characteristics of the particles when the environmental temperature is 40° C., 60° C., and 80° C.

In this exemplary embodiment, the threshold characteristics for each temperature of the particles are shown in FIG. 4A and correction different depending on the external environment can be performed for each particle type, for example, by setting an amount of correction (such as a coefficient corresponding to a variation in slope of the threshold characteristics) for each environmental temperature in advance.

In this exemplary embodiment, as indicated by mark x in FIG. 4B, color mixture occurs when the environmental temperature is 60° C., the cyan density is DC0, and the magenta density is DM3, when the environmental temperature is 60° C., the cyan density is DC3, and the magenta density is DM0, when the environmental temperature is 80° C., the cyan density is DC0, and the magenta density is DM2 and DM3, when the environmental temperature is 80° C., the cyan density is DC3, and the magenta density is DM0 and DM1, when the environmental temperature is 80° C., the cyan density is DC1, and the magenta density is DM3, and when the environmental temperature is 80° C., the cyan density is DC2, and the magenta density is DM0. Accordingly, in these cases, the threshold characteristics are changed. For example, the table shown in FIG. 4B is stored in the controller 40 in advance, it is determined whether color mixture occurs on the basis of the external environment information and the image information, and the threshold characteristics are changed when color mixture occurs.

Here, when color mixture occurs depending on the environmental temperature, the method of changing the threshold characteristics, which is performed by the controller 40, will be described below.

Figure 5:
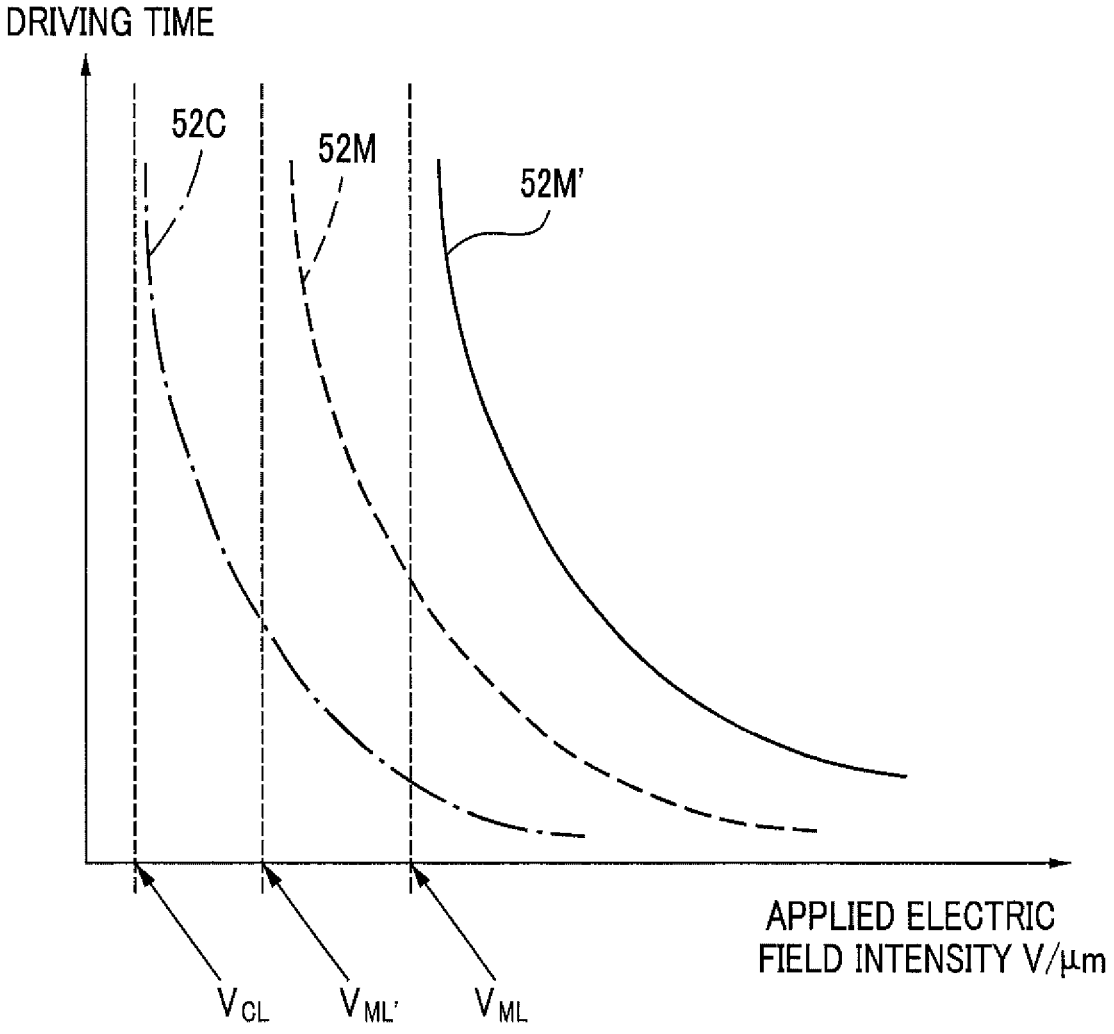
FIG. 5 is a diagram illustrating a relationship between electric field intensity and driving time.

The relationship between the electric field intensity and the driving time of particles (migration time of particles) is the same as shown in FIG. 5. In FIG. 5, the characteristic representing the relationship between the electric field intensity and the driving time of the magenta particles M is indicated by characteristic 52M and the characteristic representing the relationship between the electric field intensity and the driving time of the cyan particles C is indicated by characteristic 52C. As shown in FIG. 5, the larger the electric field applied between the substrates is, the shorter the driving time is. The smaller threshold electric field the particles have, the shorter the driving time thereof is.

Figure 6:
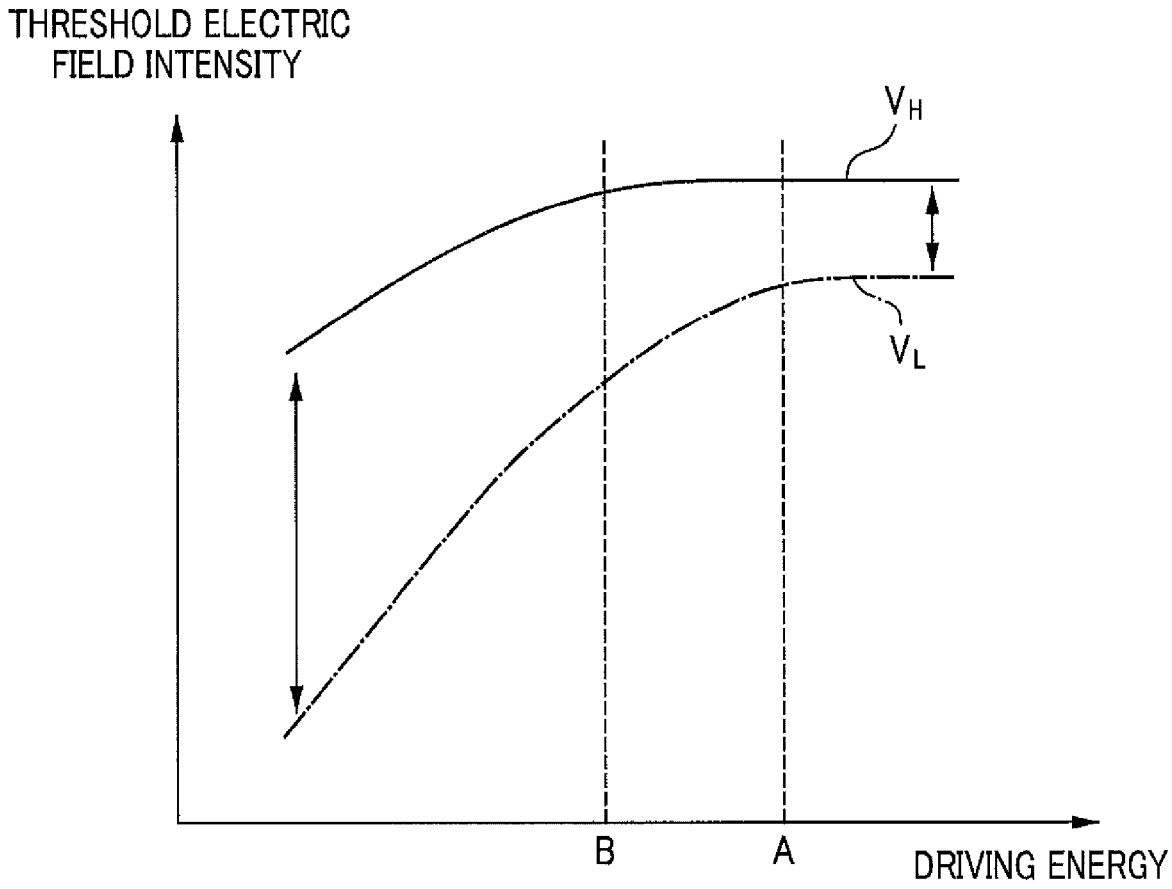
FIG. 6 is a diagram illustrating a relationship between driving energy and threshold electric field intensity.

As shown in FIG. 6, when the absolute value of the electric field intensity at which particles start migration from one substrate to the other substrate is defined as VL and the absolute value of the electric field intensity at which all the particles end the migration from one substrate to the other substrate is defined as VH, the threshold electric field intensity varies depending on the driving energy for causing the particles to migrate, and the smaller the driving energy is, the smaller the adhesive force of the particles to the substrate is and the smaller the threshold electric field intensity is. Similarly, the larger the driving energy is, the larger the adhesive force of the particles to the substrate is and the larger the threshold electric field intensity is. Here, the driving energy is a concept including the driving electric field intensity of particles and the application time thereof. The magnitude of the driving energy is determined by changing any one or both of the driving electric field intensity and the application time. For example, the threshold characteristic of the magenta particles M is threshold characteristic 50M shown in FIG. 2 as the threshold characteristic when the driving energy is B as shown in FIG. 6. Then, it is assumed that the driving energy is changed to driving energy A shown in FIG. 6, for example, by fixing the voltage value and lengthening the voltage application time. Since driving energy A is larger than driving energy B, the threshold characteristic becomes larger and is shifted from threshold characteristic 50M to threshold characteristic 50M', as shown in FIG. 2. As shown in FIG. 5, the characteristic representing the relationship between the electric field intensity of the magenta particles M and the driving time of the particles is the same as indicated by characteristic 52M'.

Therefore, in this exemplary embodiment, by causing the controller 40 to control the driving energy of the initial driving voltage for forming an initial state, the threshold characteristic of the particles can be changed. Accordingly, the controller 40 changes the threshold characteristics to prevent crosstalk by changing the driving energy of the initial driving voltage when color mixture occurs on the basis of the image information and the external environment information (environmental temperature in this exemplary embodiment). Here, the initial state means a state where an electric field (equal to or more than VMH or equal to or less than −VMH in FIG. 2) which is equal to or more than the threshold electric field of particles of which the absolute value of the threshold value is the largest is applied and all the particles migrating by the electric field migrate to any one substrate for each particle group and a state where the particle concentration is the maximum or the minimum. The electric field applied to particles to set the initial state is referred to as an initial driving electric field.

Specifically, the table (table representing occurrence of color mixture for each environmental temperature and each display density) shown in FIG. 4B, a table representing the initial driving electric field for applying an adhesive force for setting a threshold characteristic not causing crosstalk, or a table representing a writing electric field to be applied between the substrates depending on the changed threshold characteristic and the color to be displayed is stored in the controller 40 in advance, it is determined whether crosstalk occurs on the basis of the environmental temperature information and the image information, the threshold characteristic is changed to a threshold characteristic in which the crosstalk does not occur when the crosstalk occurs, and the voltage to be applied between the substrates is controlled depending on the changed threshold characteristic. Accordingly, the color mixture is suppressed even when the environmental temperature is changed and thus the threshold characteristic of particles is changed. Depending on the memory capacity or the processes in the controller 40, the table representing the occurrence of color mixture for each environmental temperature and each display density and the table representing the initial driving electric field for applying an adhesive force for setting the threshold characteristic not causing crosstalk may be combined. That is, it can also be thought that the initial driving electric field is determined by storing a table in which the initial driving electric field is determined for each environmental temperature in the controller 40 in advance, acquiring the environmental temperature, and referring to the table.

That is, in this exemplary embodiment, information of an initial driving electric field for applying an adhesive force, the absolute value of which satisfies the relational condition of migration start voltage of cyan particles C<migration end voltage of cyan particles C<migration start voltage of magenta particles M<migration end voltage of magenta particles M, to particles and information of a writing electric field to be applied to the particles on the basis of the external environment information and the color to be displayed are stored in the nonvolatile memory 40D or the like in advance, the initial driving electric field is applied between a pair of substrates on the basis of the stored information of the initial driving electric field and the external environment information, and an electric field is applied between the pair of substrates on the basis of the color to be displayed and the stored information of the writing electric field.

Figure 7:
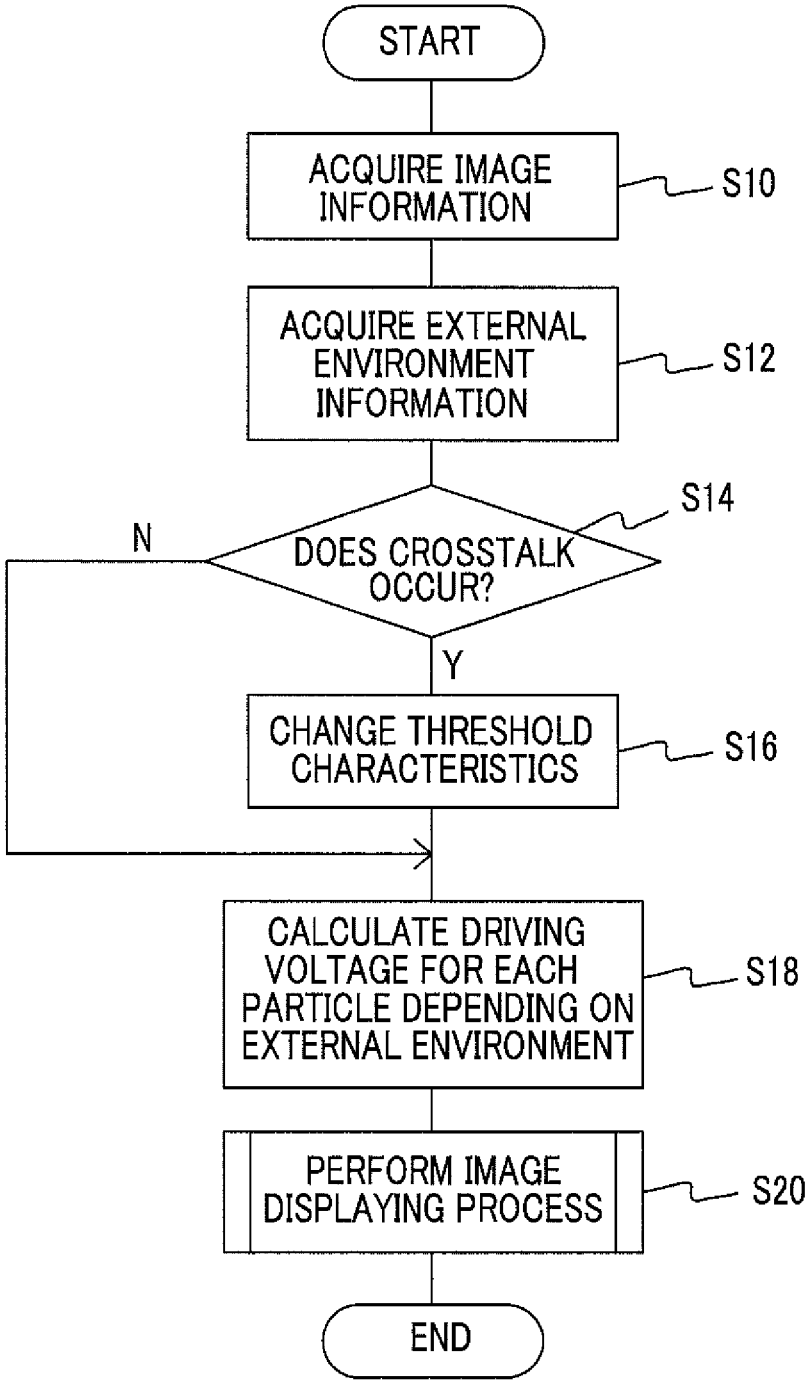
FIG. 7 is a flowchart illustrating an example of a process flow which is performed by a controller in an image display apparatus according to an exemplary embodiment of the present invention.

The control process flow which is performed by the CPU 40A of the controller 40 will be described below with reference to the flowchart shown in FIG. 7. The following processes are performed on each pixel.

In step S10, image information of an image to be displayed on the image display medium 10 is acquired from an external device not shown, for example, via the I/O 40E.

In step S12, the external environment information on the particle characteristics of the image display medium 10 is acquired from the external environment acquiring unit 22. For example, the environmental temperature around the image display medium 10 or environment information (for example, environment information in which a rise in temperature can be supposed from the intensity of light applied to the image display medium 10, the application time, and the like) in which the environmental temperature can be supposed are detected by the external environment acquiring unit 22 and the detection result is acquired through the I/O 40E.

In step S14, it is determined whether the density represented by the image information of a pixel of interest corresponds to the density causing crosstalk in the acquired external environment information (environmental temperature in this exemplary embodiment). That is, it is determined whether the density of the particles represented by the image information corresponding to the acquired environment information is a density causing color mixture using the table shown in FIG. 4B. The process flow goes to step S16 when the determination result is affirmative, and the process flow goes to step S18 when the determination result is negative. In this exemplary embodiment, when the determination result is negative, that is, when crosstalk does not occur, an image displaying process to be described later will be performed using a predetermined reference threshold characteristic as the threshold characteristic. The predetermined reference threshold characteristic is a threshold characteristic in which crosstalk of particles does not occur at a predetermined environmental temperature (for example, 20° C.), as indicated by 50C and 50M in FIG. 2.

In step S16, the threshold characteristic is changed by changing the driving energy for forming the initial state and then the process flow goes to step S18. Regarding the change of the driving energy, the driving energy for forming the initial state is changed, for example, by determining driving energy as the threshold characteristic not causing color mixture for each density causing color mixture in the table shown in FIG. 4B in advance and selecting the corresponding driving energy.

In step S18, the driving voltage for each particle group depending on the external environment is calculated. That is, the driving voltage corrected to correspond to the variation in threshold characteristic different for each particle group is calculated depending on the environmental temperature. For example, a correction coefficient or the like is calculated using a predetermined table or function for calculating the amount of correction corresponding to ΔVC2 or ΔVM2 in FIG. 2A, and the driving voltage corrected using the calculated correction coefficient is calculated for each particle group. When the threshold characteristic is changed, the driving voltage for displaying the density represented by the image information is calculated from the changed threshold characteristic.

In step S20, an image displaying process is performed and then a series of processes ends. In the image displaying process, all particles are made to migrate to one substrate to form an initial state by applying a voltage for forming the initial state, and a gray scale corresponding to the image information is displayed by performing a control so as to apply a voltage for causing the particles to migrate on the basis of the image information from the formed initial state. By applying the driving voltage for each particle group corresponding to the external environment calculated in step S18 at the time of displaying the gray scale corresponding to the image information, correction varying by the particle groups is performed depending on the environmental variation. When there is no change in threshold characteristic at the time of forming the initial state, the voltage of predetermined driving energy is applied between the substrates. When there is a change in threshold characteristic, the voltage of driving energy corresponding to the changed threshold characteristic is applied between the substrates to change the threshold characteristic. As a result, it is possible to prevent color mixture corresponding to the environmental variation.

In this way, in this exemplary embodiment, even when the threshold characteristic of a particle group is changed differently depending on the environmental variation, the density of an image to be displayed is displayed by calculating the driving voltage with an amount of correction varying depending on the particle group and applying the calculated driving voltage between the substrates. When the threshold characteristic of a particle group varies depending on the environmental variation and crosstalk occurs, the driving energy for forming the initial state is controlled to change the threshold characteristic. Accordingly, it is possible to prevent occurrence of crosstalk.

In the exemplary embodiment, the state (a state where there is no crosstalk) where the threshold characteristics of the particle groups do not overlap with each other does not mean only the state where threshold characteristics do not perfectly overlap with each other, but includes an overlap state to such an extent that color mixture cannot be sensed with a human eye. That is, the voltage at which particles start migration or the voltage at which all the particles end the migration in the above-mentioned exemplary embodiment (VCL, VCH, VML, or VMH) means a voltage at which particles substantially start migration or a voltage at which all the particles substantially end the migration, but does not mean a voltage at which a first particle of the particles starts migration or a voltage at which all the particles perfectly end the migration.

The above-mentioned exemplary embodiment mentions an example where the driving energy is changed to change the threshold characteristics of the particles by fixing the voltage value and changing the voltage application time, but the threshold characteristics of the particles may be changed by fixing the voltage application time and changing the voltage value. Alternatively, both the voltage value and the voltage application time may be changed. The driving energy may be changed by changing the number of applications of a voltage.

Since the variation in threshold characteristic differs depending on the particle type or the temperature, the threshold characteristics of cyan and magenta may get apart from each other in some cases. In this case, the adhesive force is reduced within a range in which the threshold characteristics of cyan and magenta do not crosstalk with each other. That is, when the migration end voltage in the threshold characteristic of the particles on one side and the migration start voltage in the threshold characteristic of the particles on the other side get apart from each other by a predetermined value or more, the driving energy may be changed to reduce the adhesive force so that the migration end voltage in the threshold characteristic of the particles on one side and the migration start voltage in the threshold characteristic of the particles on the other side are within a predetermined range in which crosstalk does not occur. When the adhesive force is reduced, the electric field required for driving may be small and it is thus possible to expect to shorten the time required for displaying an image.

The above-mentioned exemplary embodiment mentions an example where the particle groups include two types of magenta particles M and cyan particles C, but the colors of the particle groups are not limited to the example. The number of types of particles may be three or more. For example, the particle groups may include three types of magenta particles M, cyan particles C, and yellow particles Y, may include four types of white particles W in addition thereto, or may further include other colored particles.

The processes in the controller 40 according to the above-mentioned exemplary embodiment may be performed by hardware or may be performed by executing a software program. The program may be distributed in a state where it is stored in various storage mediums.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A driving device of an image display medium comprising:

an electric field applying unit that applies an electric field between a pair of substrates, at least one of which has a light-transmitting property, of an image display medium including first particles of which a first start voltage for starting migration and a first end voltage for ending the migration vary depending on a variation in external environment and second particles of which a second start voltage for starting migration and a second end voltage for ending the migration vary depending on the variation in external environment and displaying an image on the basis of image information, the first particles and the second particles being enclosed between the pair of substrates;

an external environment acquiring unit that acquires external environment information;

an information storage unit that stores information of an initial driving electric field for applying an adhesive force, the absolute value of which satisfies the first start voltage<the first end voltage<the second start voltage<the second end voltage, to the first particles and the second particles depending on the external environment information and information of a writing electric field to be applied to the respective particles on the basis of the external environment information and a color to be displayed; and a controller that controls the electric field applying unit so as to apply an electric field between the pair of substrates on the basis of the color to be displayed and the information of the writing electric field stored in the information storage unit after applying the initial driving electric field between the pair of substrates on the basis of the external environment information and the information of the initial driving electric field stored in the information storage unit and adjusts the electric field between the pair of substrates on the basis of the external environment and the color to prevent a cross talk.

2. The driving device of an image display medium according to claim 1, wherein the information storage unit stores the information of the initial driving electric field for applying the adhesive force, in which the first end voltage and the second start voltage are within a predetermined range, to the first particles and the second particles when the first end voltage and the second start voltage are apart from each other by a predetermined value or more.

3. An image display apparatus comprising:

an image display medium that includes first particles of which a first start voltage for starting migration and a first end voltage for ending the migration vary depending on a variation in external environment and second particles of which a second start voltage for starting migration and a second end voltage for ending the migration vary depending on the variation in external environment and that displays an image on the basis of image information, the first particles and the second particles being enclosed between a pair of substrates of which at least one has a light-transmitting property; and the driving device of the image display medium according to claim 1.

4. A non-transitory computer-readable medium storing a driving program causing a computer to function as the controller of the driving device of an image display medium according to claim 1.

* * * * *